US009126660B2

(12) United States Patent
Greenfield

(10) Patent No.: US 9,126,660 B2
(45) Date of Patent: Sep. 8, 2015

(54) MULTI-DIRECTIONAL SIGNAL ASSEMBLY

(71) Applicant: Michael Greenfield, Boca Raton, FL (US)

(72) Inventor: Michael Greenfield, Boca Raton, FL (US)

( * ) Notice: Subject to any disclaimer, the term of this patent is extended or adjusted under 35 U.S.C. 154(b) by 0 days.

(21) Appl. No.: 14/068,800

(22) Filed: Oct. 31, 2013

(65) Prior Publication Data

US 2014/0199900 A1 Jul. 17, 2014

Related U.S. Application Data

(60) Provisional application No. 61/753,011, filed on Jan. 16, 2013.

(51) Int. Cl.

| | |
|---|---|
| ***B63B 45/00*** | (2006.01) |
| ***B63B 22/16*** | (2006.01) |
| ***B63B 22/00*** | (2006.01) |
| ***B63B 22/24*** | (2006.01) |
| *B63B 22/18* | (2006.01) |
| *B63C 9/00* | (2006.01) |

(52) U.S. Cl.

CPC ..... *B63B 22/166* (2013.01); *B63B 22/00* (2013.01); *B63B 22/24* (2013.01); *B63B 22/18* (2013.01); *B63B 2201/08* (2013.01); *B63C 2009/0088* (2013.01)

(58) Field of Classification Search

USPC ..... 441/16, 20
IPC ..... B63B 22/166,22/20
See application file for complete search history.

(56) References Cited

U.S. PATENT DOCUMENTS

| | | | | |
|---|---|---|---|---|
| D207,931 | S | 6/1967 | Huret | |
| D210,708 | S | 4/1968 | Sorenson | |
| D226,594 | S | 3/1973 | Teasel | |
| 4,123,813 | A | 11/1978 | Adams | |
| 4,283,169 | A | 8/1981 | Tuomala | |
| 4,312,600 | A | 1/1982 | Schaaf et al. | |
| 4,462,145 | A | 7/1984 | Schulze | |
| 4,573,933 | A | 3/1986 | Cameron | |
| 4,781,636 | A | 11/1988 | Schurr | |
| 4,796,553 | A | 1/1989 | Cogswell et al. | |
| 4,932,910 | A * | 6/1990 | Hayday | 441/11 |
| 5,066,256 | A | 11/1991 | Ward, Sr. | |
| D328,442 | S | 8/1992 | Sloan | |
| 5,445,103 | A | 8/1995 | Bleth et al. | |
| 5,609,122 | A | 3/1997 | Jimmie | |
| 5,816,187 | A | 10/1998 | Jimmie | |
| 6,162,106 | A | 12/2000 | Shieh | |
| 6,200,026 | B1 | 3/2001 | Carmichael | |
| 6,227,766 | B1 | 5/2001 | Cook | |
| D463,306 | S | 9/2002 | Fritz | |
| 6,592,416 | B1 * | 7/2003 | Hochschild, III | 441/20 |

(Continued)

*Primary Examiner* — Stephen Avila
(74) *Attorney, Agent, or Firm* — Malloy & Malloy, P.L.

(57) ABSTRACT

A multi-directional signal assembly includes a signal display unit having one or more display surfaces, and at least one signal indicia affixed to each display surface. The multi-directional display assembly comprises a buoyant construction such that the signal indicia affixed to the display surface (s) are readily visible above the surface of a body of water in which the assembly is deployed. A counterweight mechanism is mounted to the signal display unit to maintain the signal display unit in a substantially upright, operative orientation when deployed. An illumination system comprising one or more illumination members is mounted to the signal display unit, and is actuated to increase visibility of the signal display unit while it is deployed n the surface of a body of water.

16 Claims, 9 Drawing Sheets

(56) References Cited

U.S. PATENT DOCUMENTS

| | | | |
|---|---|---|---|
| 6,652,339 | B1 | 11/2003 | Carmichael |
| 6,860,773 | B2 | 3/2005 | Carmichael |
| 7,083,484 | B2 | 8/2006 | Carmichael |
| 7,303,453 | B1 | 12/2007 | Bourke |
| 7,337,568 | B2 | 3/2008 | Johnson |
| 7,824,238 | B1 | 11/2010 | Winter |
| 2007/0105659 | A1 | 5/2007 | Kennedy, III et al. |
| 2007/0283877 | A1 | 12/2007 | Durkin |
| 2008/0070457 | A1 * | 3/2008 | Yonover et al. ..... 441/17 |
| 2010/0227517 | A1 | 9/2010 | Bailey |
| 2011/0065342 | A1 | 3/2011 | Hudson |
| 2011/0136399 | A1 | 6/2011 | Mandrik |

* cited by examiner

MULTI-DIRECTIONAL SIGNAL ASSEMBLY

BACKGROUND

1. Field of the Invention

A multi-directional signal assembly deployable in a body of water includes a signal display unit comprising a buoyant construction. The signal display unit comprises one or more signal indicia affixed thereto, wherein the signal indicia are visible from essentially any point along a circle circumscribed along an axis through the assembly.

2. Description of the Related Art

The U.S. dive flag is an internationally recognized symbol indicating that one or more diver, snorkeler, or swimmer is in a body of water in the vicinity of the dive flag. This is a critical indication to alert boaters to the presence of one or more person in the water, such that they can adjust their course and avoid endangering the divers, snorkelers, etc. The most common means for the presentation of the U.S. dive flag is literally a flat, two-dimensional flag that is affixed to one end of a short flagpole, which is then affixed to an upper end of a small float or small buoy. While this may be adequate in calm waters on a clear day, with little wind, where the dive flag remains upright, unfurled, and reasonably visible to approaching boats, such days are few and far between.

As such, a number of devices have been developed in attempts to improve the visibility and alert boaters to the presence of a dive flag, and more importantly, the divers or other person in the water proximate thereto. One such device incorporates three separate two-dimensional dive flags each originating and extending outwardly from a common central flag pole or mast. A U.S. dive flag symbol is displayed across two panels of adjacent ones of the three dive flags. That is to say, one half of the U.S. dive flag is displayed on each side of each of the three two-dimensional dive flags, with adjacent sides forming the complete symbol. While the incorporation of three flags would seem to improve visibility, the fact remains that if a boater is on a course aligned with an edge of one of the three two-dimensional flags, the dive flag symbols may not be readily visible to the boater.

Another device comprises an inflatable body member having three or four sides, each having a dive flag symbol on each side. While this eliminates the issues associated with collapsible two dimensional flags, as well as lack of visibility along certain bearings of an oncoming watercraft, the body is structured to float directly on the surface of the water, such that in even modest wind and waves, the marker may be only intermittently visible to boaters in an oncoming vessel.

As such, it would be beneficial to provide a multi-directional signal assembly which is buoyant, so as to float on the surface of the water, and which includes one or more elongated display surface having an upper portion and a lower portion, and signal indicia affixed to the upper portion of the display surface to increase visibility to oncoming boaters by virtue of being maintained above the surface of the water. A counterweight mechanism structured to maintain the display surface(s) in a generally upright orientation while deployed would provide a further benefit. It would also be advantageous to combine an illumination system with such a multi-directional signal display, once again, to improve visibly of the assembly to oncoming boaters regardless of their course or bearing relative to the assembly while it is deployed in a body of water.

SUMMARY

The present disclosure is directed to a new and novel multi-directional signal assembly deployable on a surface of a body of water. More importantly, the present disclosure provides a multi-directional signal assembly which is essentially visible from any point along a circle circumscribed around a vertical axis through the assembly.

A multi-directional signal assembly in accordance with the present disclosure comprises a signal display unit having a buoyant construction. The signal display unit comprises at least one display surface, however, in at least one embodiment, the signal display unit comprises a plurality of display surfaces. In one further embodiment, each of the plurality of display surfaces comprises a substantially rectangular configuration having an upper portion and a lower portion, and yet one further embodiment, each of the display surfaces comprises a rigid material of construction.

A signal display unit in accordance with one embodiment of the present disclosure includes an upper cap member and a lower cap member mounted at oppositely disposed ends of the plurality of display surfaces. In one embodiment, the lower cap member includes a dry storage container, and in at least one other embodiment, a power supply/control containment is provided in the lower cap member. In at least one embodiment, a power supply/control containment is mounted in an upper cap member.

In addition, the multi-directional signal assembly in accordance with the present disclosure comprises at least one signal indicia, and in at least one embodiment, a plurality of signal indicia, wherein at least one of the plurality of signal indicia is affixed onto an upper portion of a different one of each of the plurality of display surfaces. The signal indicia may comprise any of a plurality of images in order to covey a desired message including, in at least one embodiment, the signal indicia comprises a United States dive flag to indicate that one or more diver or snorkeler is in the water in the vicinity of the multi-directional signal assembly.

A counterweight mechanism is interconnected to the signal display unit in at least one embodiment in order to maintain the signal display unit in an operative orientation relative to the surface of the body of water. The operative orientation is at least partially defined by each of the plurality of display surfaces disposed in a substantially upright orientation relative to the surface of the body of water. The operative orientation may be further defined by maintaining the upper portion of each of the plurality of display surfaces substantially above the surface of the body of water, such that the display indicia affixed thereon is readily visible.

In accordance with at least one further embodiment of the present disclosure, an illumination system is mounted to the signal display unit. The illumination system comprises at least one illumination member to increase the visibility of the signal display unit while it is deployed in a body of water. In yet one further embodiment, an illumination system comprises a plurality of illumination members to increase the visibility of the signal display unit while deployed in an operative orientation on the surface of the body of water.

A controller is provided in at least one embodiment and is programmed to independently actuate one or more illumination member(s) upon detection of at least one environmental parameter.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION

As previously stated, the present disclosure is directed to a multi-directional signal assembly, generally as shown as at 10 throughout the figures. In at least one embodiment, a multi-directional signal assembly 10 in accordance with the present disclosure comprises a signal display unit 20 having a plurality of display surfaces 21, wherein at least one of said plurality of display surfaces 21 is visible from any point along a circle circumscribed around a vertical axis through the signal display unit 20 and planar with the plurality of display surfaces 21. Stated otherwise, at least one of the plurality of display surfaces 21 of the present multi-directional signal assembly 10, and more importantly, a signal indicia 22 displayed thereon, is visible from any direction which is generally perpendicular to the display surfaces 21.

Figure 1:
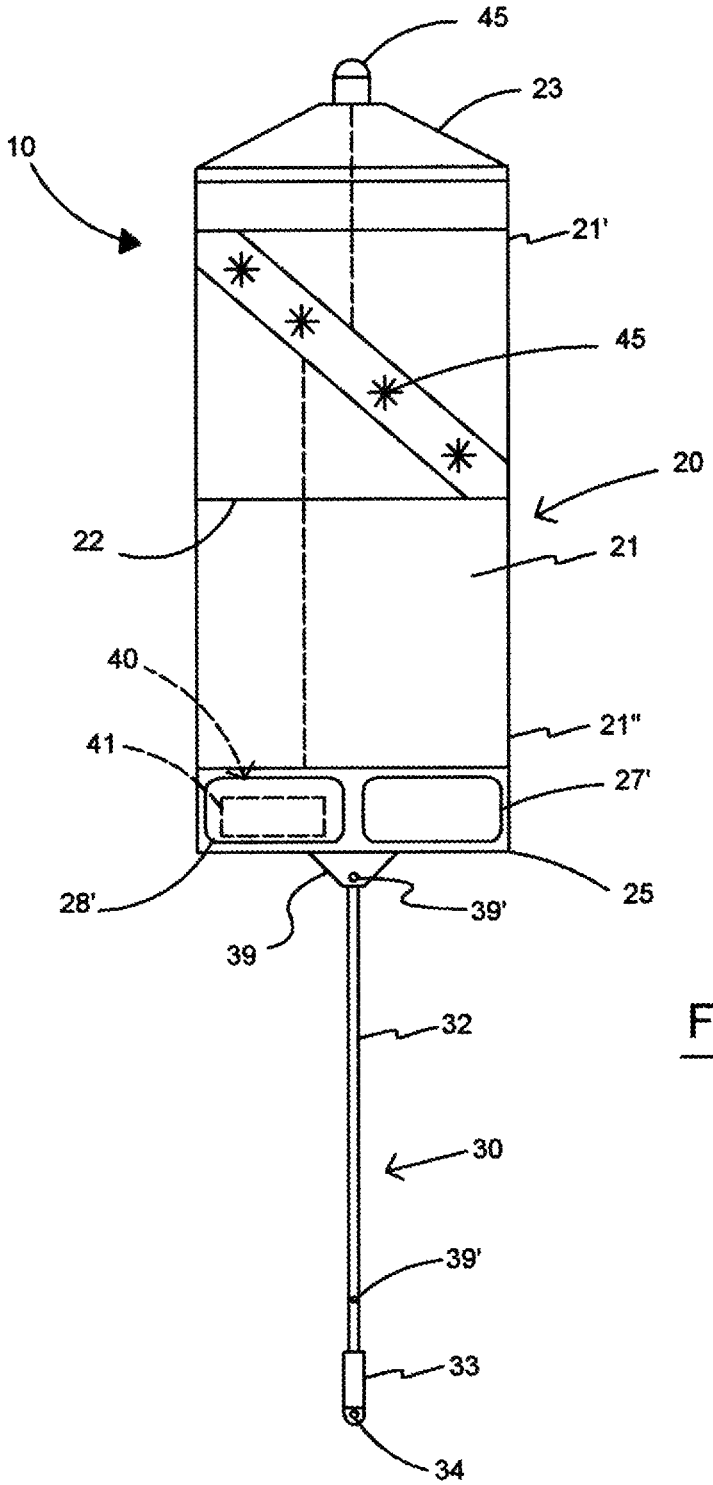
FIG. 1 is a front elevation of one illustrative embodiment of a multi-direction signal assembly in accordance with the present disclosure.

FIG. 1 is illustrative of one embodiment of a multi-directional signal assembly 10 in accordance with the present disclosure. More in particular, FIG. 1 presents a front elevation of one embodiment of a multi-directional signal assembly 10 comprising a signal display unit 20. As may be seen from the illustrative embodiment of FIG. 1, the signal display unit 20 comprises display surface 21 having a signal indicia 22 affixed to an upper portion 21' thereof. Display surface 21, in at least one embodiment, comprises a substantially rectangular configuration having a length and a width, wherein the length of the display surface 21 is aligned with a vertical axis through the center of the signal display unit 20. FIG. 1 further illustrates one embodiment of a counterweight mechanism 30, which is shown in a deployed orientation.

Signal indicia 22, in accordance with at least one embodiment of the present disclosure, comprises a Unites States dive flag, which is a widely known and readily recognizable signal indicating that a diver or snorkeler is in the water in the vicinity of the dive flag. The U.S. dive flag is crucial to mark the location of divers or snorkelers in the water, so that boats can steer clear of the area for obvious safety reasons. The U.S. dive flag consists of a bright red or orange square having a broad white band running diagonally therethrough from the upper left corner to the lower right corner, such as is shown best in the illustrative embodiments of FIGS. 3 and 9.

In one embodiment, the signal indicia 22 comprises a U.S. Coast Guard ("USCG") approved reflective tape. As one example, an orange 3M™ Marine Grade USCG High Intensity Reflective Adhesive Tape, Product No. 3M USCGFP-34, manufactured by 3M Company, St. Paul, Minn., is utilized to form the square portion of the U.S. dive flag on an upper portion 21' of a corresponding display surface 21. In a further embodiment, a white 3M™ Marine Grade USCG High Intensity Reflective Adhesive Tape, Product No. 3M USCGFP-30, once again, manufactured by 3M Company, St. Paul, Minn., is utilized to form the diagonal band through the orange square of the U.S. dive flag. In at least one embodiment, signal indicia 22 comprises a U.S. dive flag having a substantially square configuration and being approximately twelve inches by twelve inches.

In yet one further embodiment in accordance with the present disclosure, white 3M™ SOLAS Marine Grade USCG High Intensity Reflective Adhesive Tape, Product No. 3M USCGFP-30, is affixed to the lower portion 21" of each display surface 21, to provide further overall visibility to the signal display unit 20 while deployed in a body of water. Alternatively, a white marine paint may be applied to the lower portion 21" of each display surface 21 and/or to each of upper cap member 23 and lower cap member 25, each described in further detail below.

Figure 2:
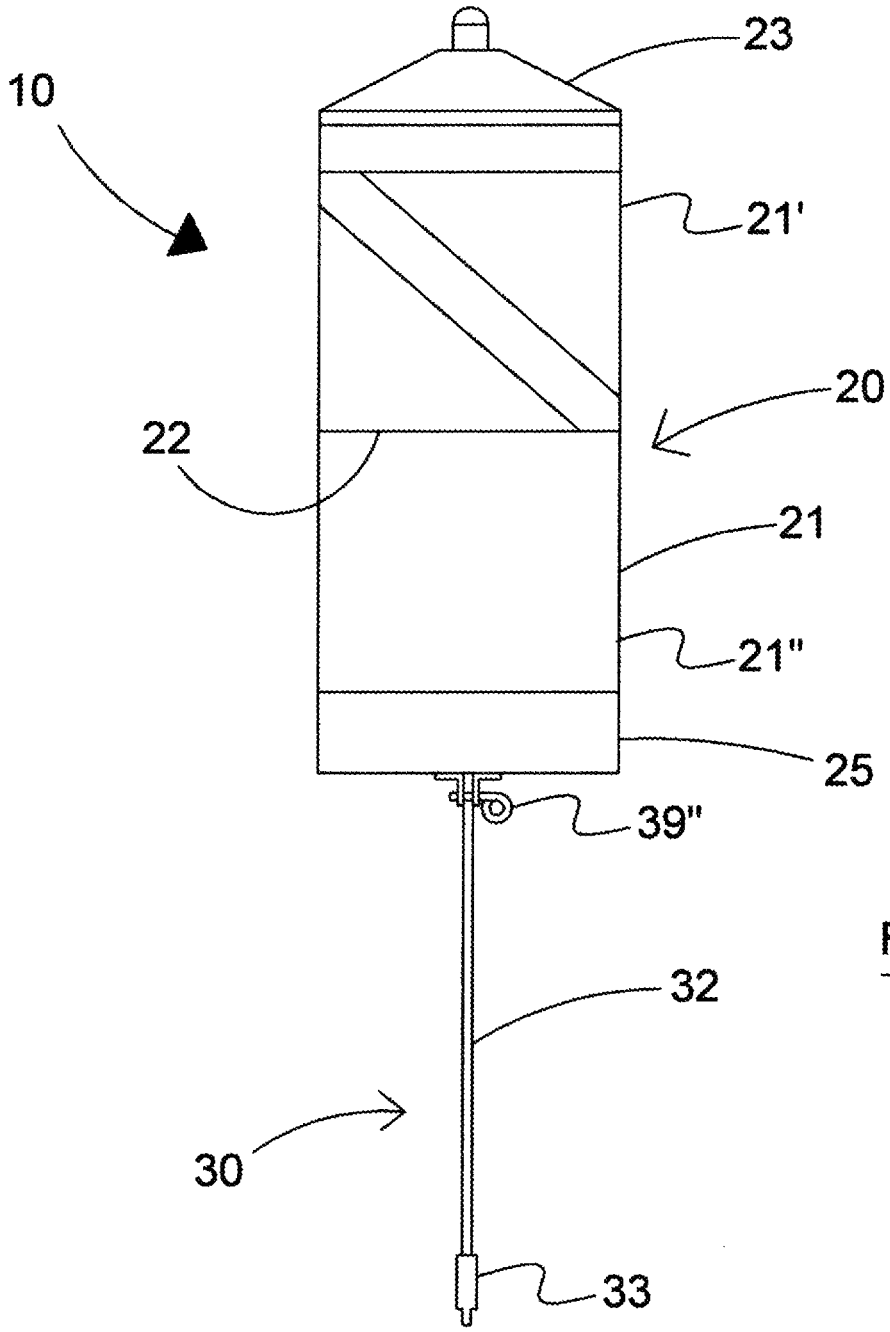
FIG. 2 is a side elevation of the illustrative embodiment of the multi-direction signal assembly of FIG. 1.

FIG. 2 presents an elevation of one side of the illustrative embodiment of FIG. 1, showing another of the plurality of display surfaces 21 of the signal display unit 20. FIG. 2 is further illustrative of another of the plurality of signal indicia 22 affixed to an upper portion 21' of corresponding display surface 21. FIG. 2 also presents a side elevation of the counterweight mechanism 30, once again, shown in a deployed orientation.

Figure 3:
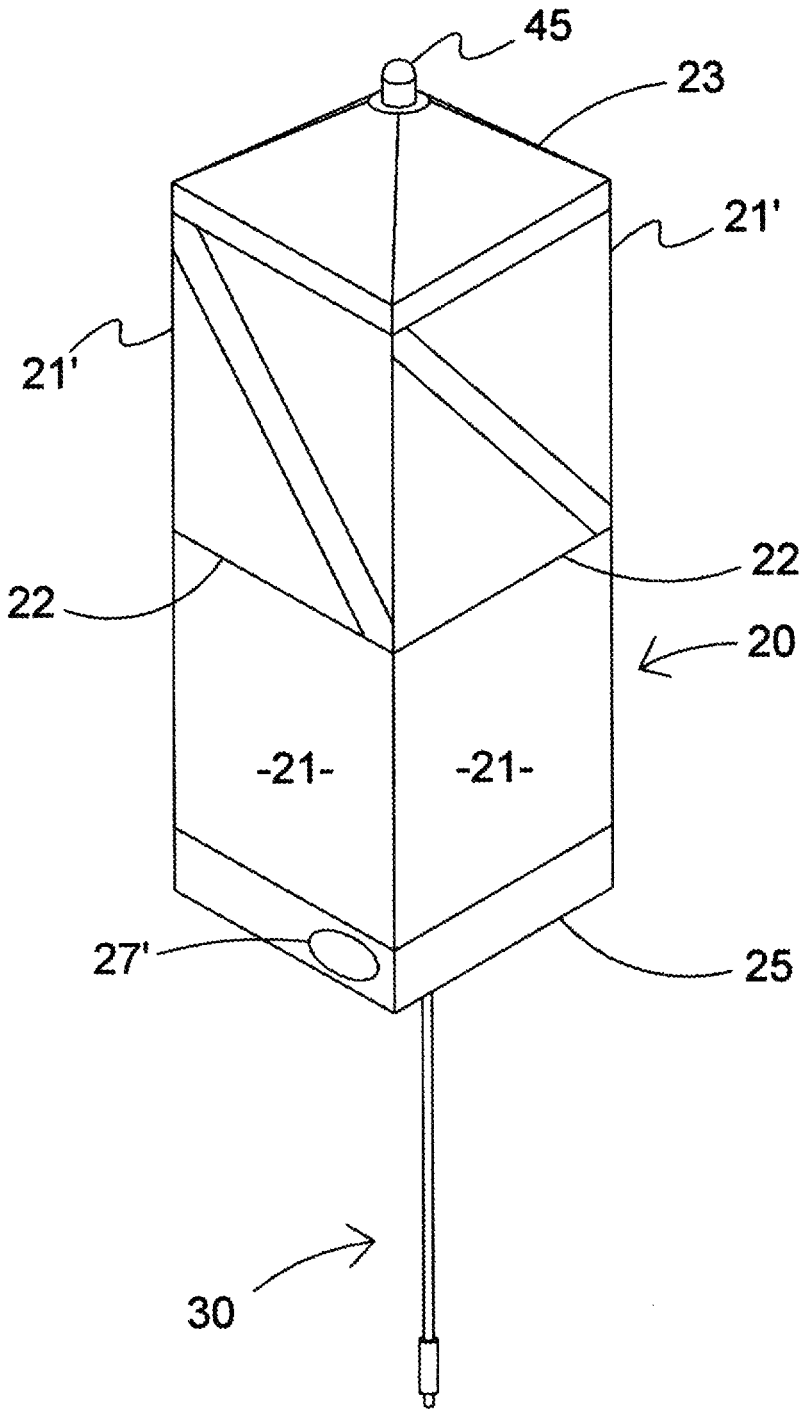
FIG. 3 is a perspective view of another illustrative embodiment of a multi-directional signal assembly in accordance with the present disclosure.

FIG. 3 is a perspective view of another embodiment of the multi-directional signal assembly 10. As clearly shown in the illustrative embodiment of FIG. 3, the signal display unit 20 comprises a plurality of display surfaces 21 each having at least one of a plurality of signal indicia 22 affixed thereto. Once again, each of the plurality of signal indicia 22 are affixed to an upper portion 21' of a corresponding one of the plurality of display surfaces 21. As will be appreciated from the illustrative embodiment of FIG. 3, at least one of the plurality of signal indicia 22 affixed to an upper portion 21' of one of the plurality of display surfaces 21 of the present multi-directional signal assembly 10 will be visible from any direction in a field of view which is generally perpendicular to the display surfaces 21.

Figure 7:
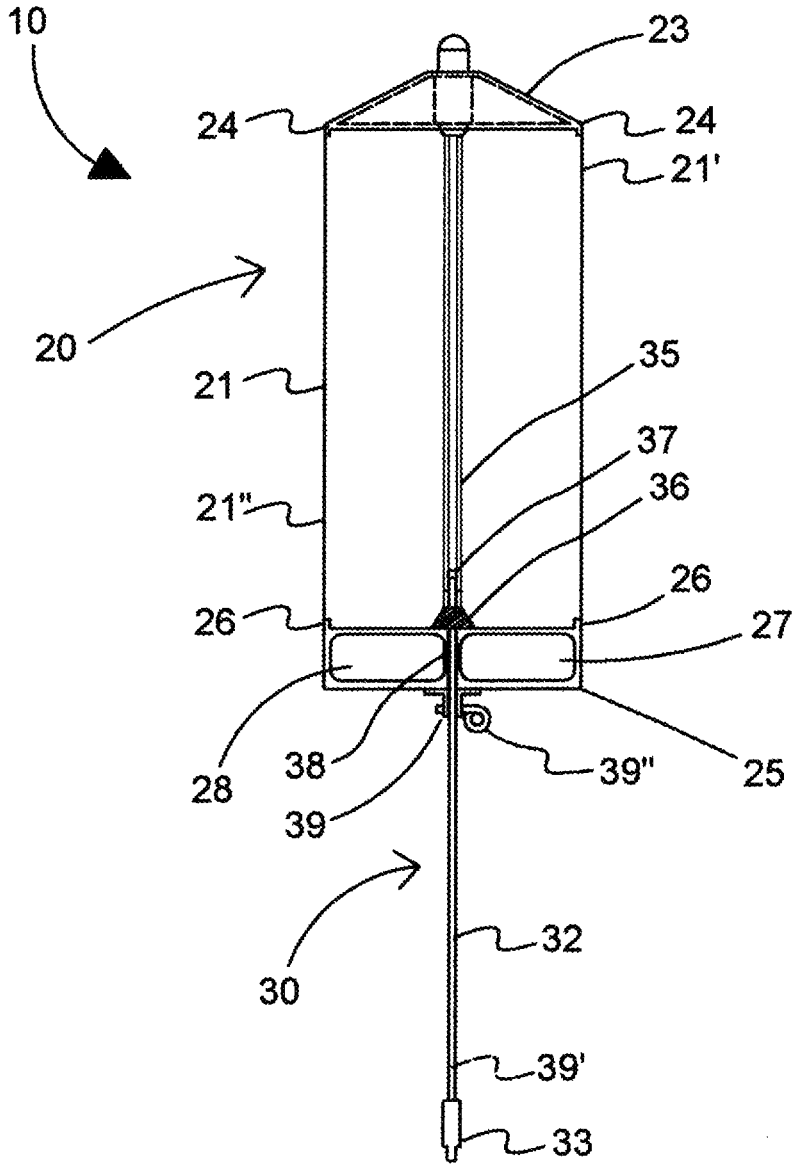
FIG. 7 is a partial cutaway view of one embodiment of a multi-direction signal assembly in accordance with the present invention illustrative of a counterweight mechanism in a deployed orientation.

As shown in the illustrative embodiments of FIGS. 1 through 3, the signal display unit 20 comprises an upper cap member 23 and a lower cap member 25. As may be seen best in FIG. 7, upper cap member 23 comprises a plurality of upper cap flanges 24. As also shown in FIG. 7, each of the plurality of upper cap flanges 24 are disposed to engage a corresponding one of the plurality of display surfaces 21. More in particular, the upper cap member 23 is affixed to an upper end of each of the plurality of display surfaces 21. In one embodiment, the upper cap member 23 is affixed to each of the plurality of display surfaces 21 via mechanical fasteners, for example, screws, bolts, rivets, staples, etc. Alternatively, chemical or heat welding may also be utilized to affix upper cap member 23 to each of the plurality of display surfaces 21. In at least one embodiment, a watertight or water resistant adhesive is utilized to securely affix upper cap member 23 to an upper end of each of the plurality of display surfaces 21.

Similarly, and with continued reference to the illustrative embodiment of FIG. 7, lower cap member 25 comprises a plurality of lower flanges 26, each structured to engage a corresponding lower end of each of display surfaces 21. Similar to upper cap member 23, lower cap member 25, and more in particular, the plurality of lower cap flanges 26, may be attached to each of the plurality of display surfaces 21 via mechanical fasteners, or chemical/heat welding. In at least one embodiment, a watertight or water resistant adhesive is utilized to affix each of plurality of lower cap flanges 26 of the lower cap member 25 to a lower end of each of the plurality of display surfaces 21.

In at least one embodiment, both upper cap member 23 and lower cap member 25 are constructed of an acrylonitrile-butadiene-styrene ("ABS") thermoplastic material and, in one further embodiment, injection molding is utilized to form upper cap member 23 and lower cap member 25 from ABS. In addition, each of the plurality of display surfaces 21, in one embodiment, comprises a urethane foam construction. In yet one further embodiment, the plurality of display surfaces 21 comprise a unitary construction, i.e., the plurality of display surfaces 21 form a singular square rectangular configuration. In one embodiment, a synthetic elastomeric adhesive is utilized to affix upper cap member 23 and lower cap member 25 to the plurality of display surfaces 21. As one example, SCOTCH-WELD™ High performance Industrial Plastic Adhesive, Product Number 4693H, manufactured by 3M Company, St. Paul, Minn., is utilized to affix cap members 23, 25 to each of the plurality of display surfaces 21.

Thus, the combination of a watertight interconnection between the upper cap member 23 and lower cap member 25 with each of the plurality of display surfaces 21 provides a buoyant construction to signal display unit 20, such that, it will float in a body of water. Further, this buoyant construction and the configuration of the plurality of display surfaces 21 is such that a substantial portion of the signal display unit 20 will remain above the surface of the body of water in which it is deployed.

In one alternate embodiment, a signal display unit 20 comprises a polystyrene foam core or shell having a plurality of display surfaces 21 securely affixed to each side of the signal display unit 20. As before, the display panels 21, in one embodiment, comprise a urethane foam construction. In at least one embodiment, the signal display unit 20 comprises a square rectangular polystyrene foam core or shell approximately eleven inches by eleven inches by thirty inches in length, and has one inch thick urethane foam display panels 21 affixed along each side thereof. In this configuration, the display unit 20 comprises a buoyancy of about one hundred and twenty pounds force. Alternatively, a polystyrene core is injected into an assembled arrangement of urethane foam display panels 21. As result of the inherent buoyancy provided by the construction of such an embodiment of a signal display unit 20, the need for a lower cap member 25 being affixed to display panels 21 via a watertight seal or adhesive is eliminated. Of course, a lower cap member 25 may still be incorporated into such embodiment, for example, to seal the polystyrene foam core and/or to provide a housing for a dry storage container 27, as described in further detail below. Similarly, an upper cap member 23 affixed to display panels 21 is not necessary in such an embodiment, but may be included to provide a housing for one or more sensors 44 or illumination members 45, also disclosed in further detail below.

Figure 4:
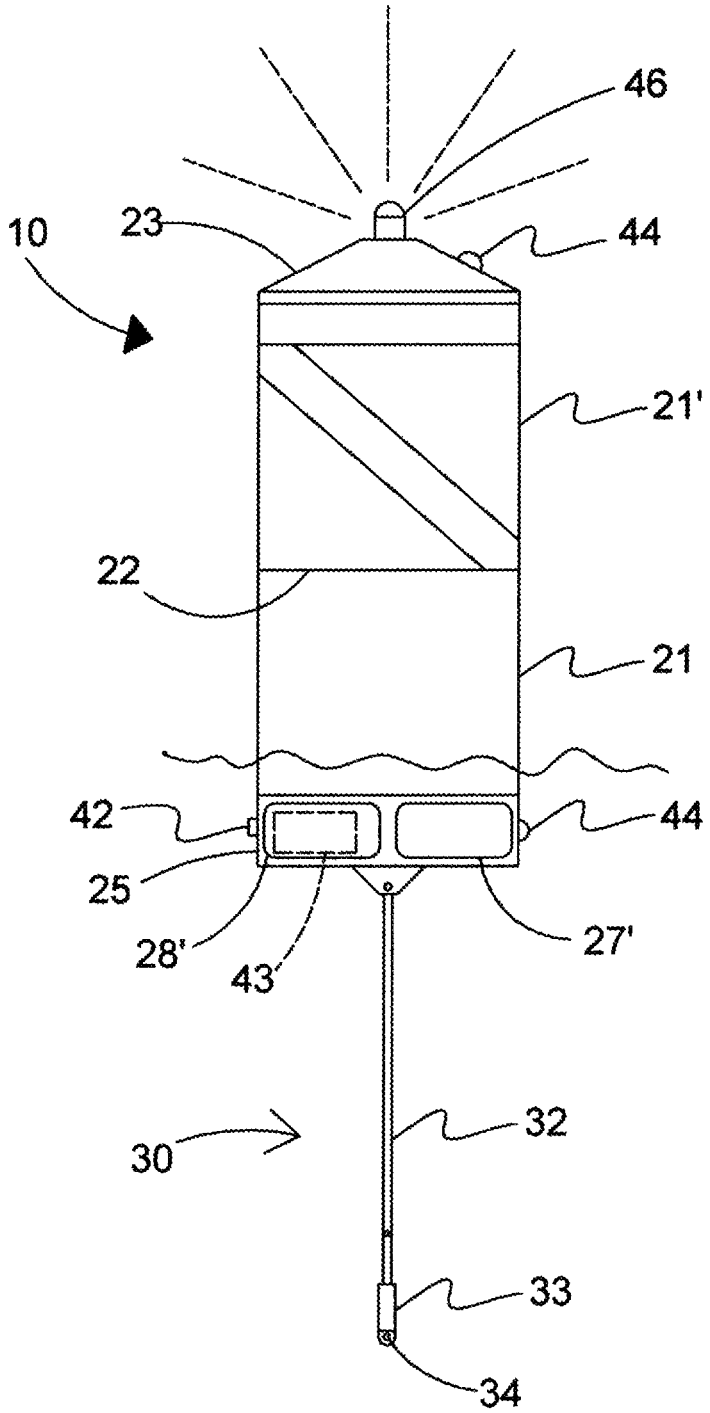
FIG. 4 is a front elevation of the illustrative embodiment of the multi-direction signal assembly of FIG. 1 deployed in a body of water.
Figure 5:
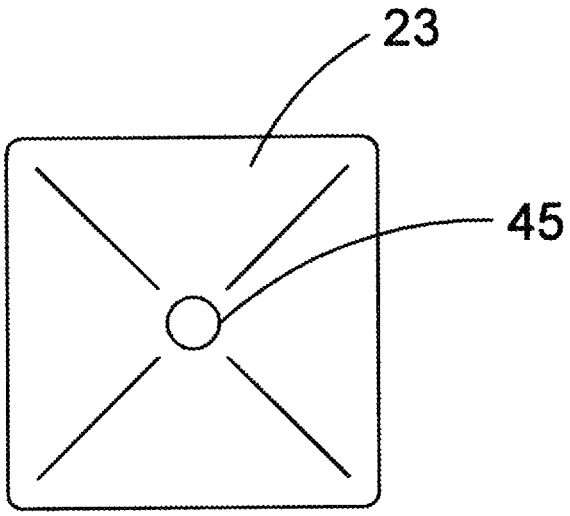
FIG. 5 is a top plan view of one illustrative embodiment of a multi-direction signal assembly in accordance with the present invention.

Looking again to the illustrative embodiment of FIG. 1, in at least one embodiment, a multi-directional signal assembly 10 in accordance with the present disclosure comprises an illumination system 40 having at least one illumination member 45. Illumination system 40 includes a power supply 41 which may be actuated by a float switch 42, such as illustrated in FIG. 4. In one embodiment, the power supply 41 comprises one or more dry storage batteries. The float switch 42, in at least one embodiment, is structured to close the electrical circuit between the illumination system 40 and the power supply 41 upon immersion in a body of water, once again, as shown by way of example in FIG. 4. Of course, it is understood to be within the scope and intent of the present invention to provide other mechanisms to actuate the illumination system 40 including, by way of example only, a manual switch mechanism actuated by a user, a timer switch mechanism, or a sensor actuation mechanism, such as is described in further detail below.

Figure 9:
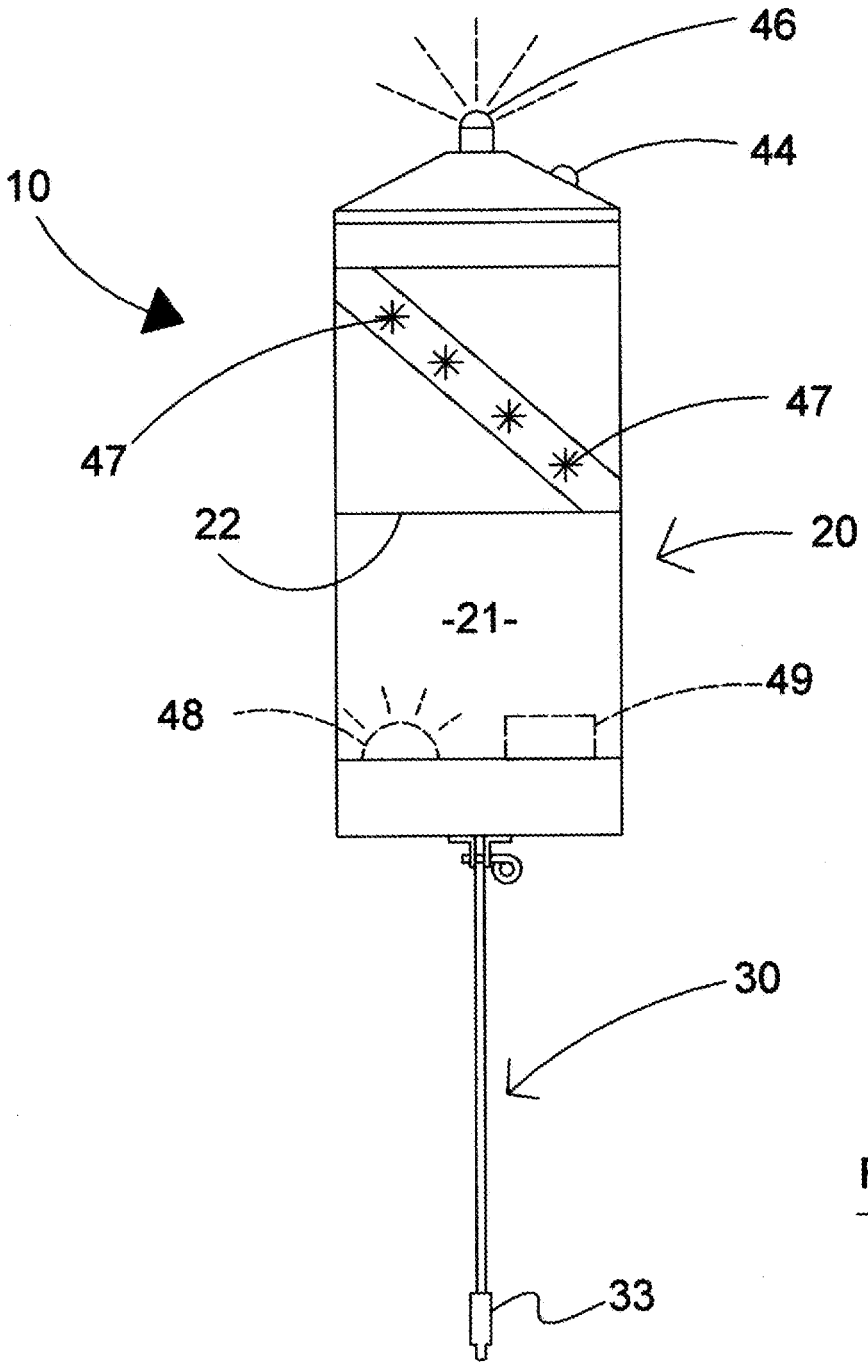
FIG. 9 is an elevation of yet another illustrative embodiment of a multi-directional signal display assembly in accordance with the present disclosure.

As indicated above, in at least one embodiment the illumination system 40 further comprises a controller 43 which is programmed to actuate at least one illumination member 45 of the illumination system 40. In accordance with the illustrative embodiments presented in several of the figures, the illumination system 40 in accordance with the present disclosure comprises a plurality of illumination members 45. In one such embodiment, the controller 43 is programmed to independently actuate each of the plurality of illumination members 45. In yet one further embodiment, the controller 43 is programmed to actuate one or more of the plurality of illumination members 45 upon detection of at least one environmental parameter. For example, in one embodiment, a flashing light emitting diode 46 is mounted to an upper cap member 23 of the signal display unit 20, and the controller 43 is programmed to actuate the flashing light emitting diode 46 upon detection of a predetermined level of fog proximate the multi-directional signal assembly 10, via one or more sensors 44, such as shown in FIG. 4. Similarly, controller 43 may be programmed to illuminate a plurality of illumination members 45, such as, flashing light emitting diode 46, indicia light emitting diode 47 and/or internal light emitting diode 48, such as are shown throughout the figures, based upon a preselected level of available ambient light proximate the multi-directional signal assembly 10, once again, such as may be detected via a sensor 44, such as is illustrated in FIG. 9. In another embodiment, an accelerometer may be employed to detect wave motion, and to actuate or flash one or more illumination members 45 upon detection a crest of a wave, once again, to increase visibility of the signal display unit 20 while deployed in a body of water.

One or more sensors 44 may also be employed to detect pressure or leakage of water into the signal display unit 20, such as may result in failure to properly display the plurality of signal indicia 22. In yet one further embodiment of a multi-directional signal assembly 10 in accordance with the present disclosure, an electronic shark repellent mechanism 49 may be mounted to the signal display unit 20, such as is illustrated in FIG. 9, which emits an electrically generated signal which is known to deter sharks. The electronic shark repellent mechanism 49 may be automatically actuated when the assembly 10 is deployed in a body of water, such as via a float switch 42. Alternatively, the electronic shark repellent mechanism 49 may be actuated by a user in the event one or more sharks are visibly detected it the area, or in the event of an emergency or distress situation.

One or more sensors 44 may be combined with a digital display to indicate one or more environmental parameters including, but not limited to, water temperature, air temperature, wave height, battery capacity, diver depth, depth temperature, etc. A digital display may be mounted directly to the signal display unit 20 and/or attached at one end of diver/snorkeler tether to provide an immediate indication of the parameter(s) to the user.

As previously indicated, and with reference to the illustrative embodiments of FIGS. 1 and 2, the multi-directional signal assembly 10 in accordance with the present disclosure comprises a counterweight mechanism 30. A counterweight mechanism 30, in accordance with at least one embodiment, includes a weight deployment member 32 structured to have a weight 33 mounted thereto. In at least one embodiment, the weight deployment member 32 comprises an elongated rod or pole which extends downwardly and outwardly from the lower cap member 25 of the signal display unit 20. As shown in FIG. 1, the weight 33 may include an interconnection eyelet 34, which will allow the multi-directional signal assembly 10 to be attached to a tie line of a water craft, or to a tether attached to a user. In one embodiment, a further weight or anchor line is attached to the interconnection eyelet 34, so as to maintain the multi-directional signal assembly 10 in a particular location when deployed a body of water.

A deployment member lock mechanism 39 is provided which, in at least one embodiment, includes one or more apertures 39' through the weight deployment member 32, corresponding to an aperture 39' through deployment lock mechanism 39. In one further embodiment, a pin 39" is provided to pass through the apertures 39' of the deployment lock mechanism 39, thereby maintaining weight deployment member 32 in either a deployed orientation as shown, for example, in FIGS. 1 through 4, or in a retracted orientation, such as is shown in FIG. 8.

Figure 8:
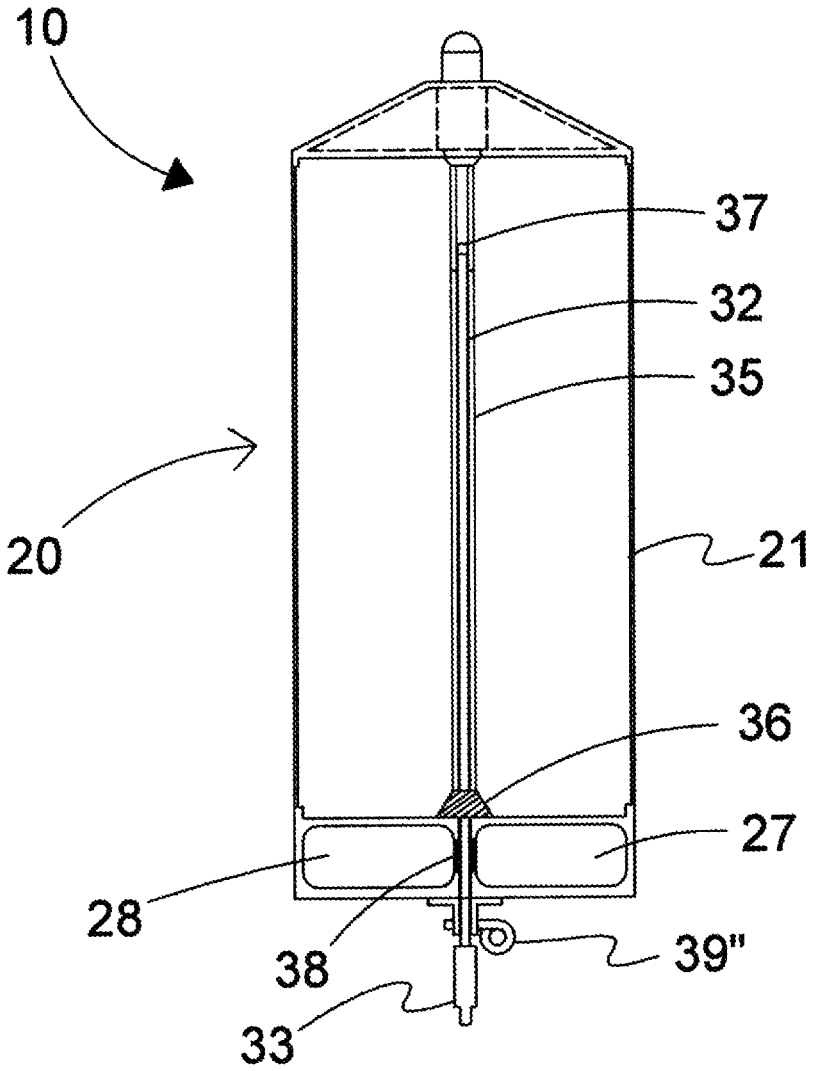
FIG. 8 is a partial cutaway view of the illustrative embodiment of a multi-direction signal assembly of FIG. 7 illustrative of the counterweight mechanism in a stowed orientation.

Looking further to FIGS. 7 and 8, in at least one embodiment, the counterweight mechanism 30 includes a deployment member housing 35 which is mounted in signal display unit 20. More in particular, deployment member housing 35 is dimensioned to receive a substantial portion of the weight deployment member 32 therein while the weight deployment member 32 is disposed in a retracted orientation, once again, as shown best in FIG. 8. In at least one further embodiment, and again with reference to FIGS. 7 and 8, counterweight mechanism 30 comprises a bearing mechanism 36 structured to facilitate repositioning of the weight deployment member 32 between a deployed orientation and a retracted orientation, as shown in FIGS. 7 and 8, respectively. In at least one embodiment, weight deployment member 32 includes a stop member 37 attached to one end so as to prevent weight deployment member 32 from being completely removed from the deployment member housing 35. More in particular, stop member 37 will abut against bearing mechanism 36 when the weight deployment member is fully extended outwardly from deployment housing 35 so as to prevent complete removal therefrom. In at least one further embodiment, and once again as shown in FIGS. 7 and 8, a watertight seal 38 is provided so as to prevent, or at least significantly minimize, the entry of water into the deployment member housing 35 and/or, more importantly, into the interior of the signal display unit 20, thereby maintaining the buoyant construction of the same. In an embodiment having a signal display unit 20 comprising a polystyrene core or shell, as disclosed above, the need for a watertight seal 38 is, of course, not necessary to maintain buoyancy.

FIGS. 7 and 8 are further illustrative of a dry storage container 27 formed in lower cap member 25 in at least one embodiment, thereby providing a user with a secure and dry location to store his or her valuables while swimming, diving, or snorkeling. In at least one embodiment, the dry storage container 27 is as manufactured by Otter Products, LLC of Fort Collins, Colo., and sold as part of the OTTERBOX® product line. A removable watertight cover 27', such as shown in FIG. 1, is provided to close dry storage container 27 and to form a water tight seal therewith. Also shown in FIGS. 7 and 8 is a power supply/control containment 28 which is also formed in lower cap member 25. The watertight cover 28' may be removably attached or, in at least one embodiment, permanently attached to seal the power supply/control containment 28 after power supply 41 and/or controller 43 are installed therein.

Figure 6:
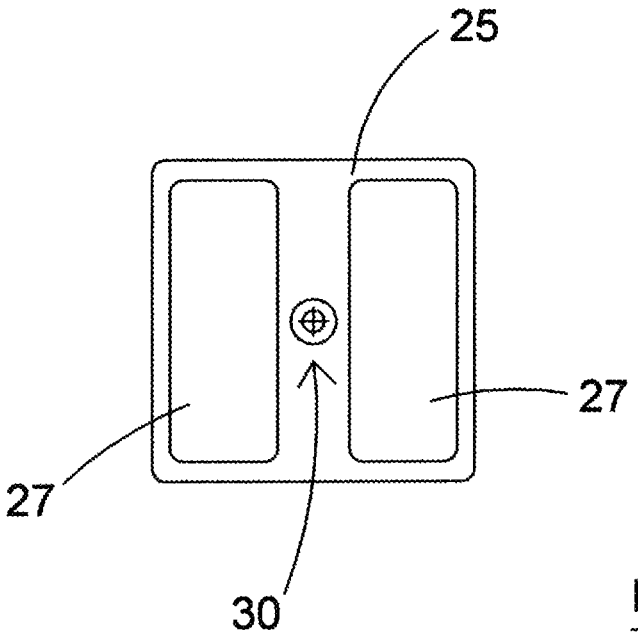
FIG. 6 is a bottom plan view of one illustrative embodiment of a multi-direction signal assembly in accordance with the present disclosure.

In at least one embodiment, the power supply/control containment 28 is formed in an upper cap member 23, and in one further embodiment, a watertight closure 28' is also affixed in a sealing engagement with the opening of power supply/control containment 28. In such an embodiment, the lower cap member 25 may comprise a plurality of dry containers 27, as shown in the illustrative embodiment of FIG. 6.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A multi-directional signal assembly deployable on a surface of a body of water, said assembly comprising:

a signal display unit comprising a buoyant construction, said signal display unit further comprising a plurality of display surfaces, each of said display surfaces having a rigid material of construction, a plurality of signal indicia, wherein at least one of said plurality of signal indicia is affixed onto a different one of each of said plurality of display surfaces, a counterweight mechanism interconnected to said signal display unit and disposable between a deployed orientation and a retracted orientation, said counterweight mechanism maintaining said signal display unit in an operative orientation relative to the surface of the body of water when disposed in said deployed orientation, an illumination system mounted to said signal display unit, said illumination system comprising a plurality of illumination members which increase visibility of said signal display unit while deployed in said operative orientation on the surface of the body of water.

2. The assembly as recited in claim 1 wherein each of said plurality of display surfaces comprises a substantially rectangular configuration having a width and a length, and said operative orientation of said signal display unit is at least partially defined by said length of each of said plurality of display surfaces disposed in a substantially upright orientation relative to the surface of the body of water; and a controller programmed to independently actuate each of said plurality of illumination members upon detection of at least one environmental parameter.

3. The assembly as recited in claim 2 wherein a majority of said length of each of said plurality of display surfaces is above the surface of the body of water while said signal display unit is disposed in said operative orientation.

4. The assembly as recited in claim 3 wherein each of said plurality of signal indicia is affixed on an upper portion of a corresponding one of said plurality of display surfaces.

5. The assembly as recited in claim 4 wherein at least one of said plurality of signal indicia affixed onto each of said plurality of display surfaces comprises a United States dive flag.

6. The assembly as recited in claim 1 wherein said signal display unit comprises at least four display surfaces.

7. A multi-directional signal assembly deployable on a surface of a body of water, said assembly comprising:

a signal display unit comprising a buoyant construction, said signal display unit further comprising four display surfaces, each of said four display surfaces having a substantially rectangular configuration comprising an upper portion and a lower portion, and a rigid material of construction, said four display surfaces disposed relative to one another forming a square rectangular configuration, a plurality of signal indicia, wherein at least one of said plurality of signal indicia is affixed onto said upper portion of a different one of each of said four display surfaces, a counterweight mechanism interconnected to said signal display unit maintaining said signal display unit in an operative orientation relative to the surface of the body of water, wherein said operative orientation is at least partially defined by each of said four display surfaces disposed in a substantially upright orientation relative to the surface of the body of water, an illumination system mounted to said signal display unit, said illumination system comprising a plurality of illumination members which increase visibility of said signal display unit while deployed in said operative orientation on the surface of the body of water; and a controller programmed to independently actuate each of said plurality of illumination members upon detection of at least one environmental parameter.

8. The assembly as recited in claim 7 wherein said at least one illumination member comprises an internal light emitting diode mounted in said signal display unit.

9. The assembly as recited in claim 7 wherein said at least one illumination member comprises an indicia light emitting diode mounted to at least one of said four display surfaces.

10. The assembly as recited in claim 9 wherein said indicia light emitting diode is mounted concomitant a corresponding one of said plurality of signal indicia.

11. The assembly as recited in claim 7 wherein said counterweight mechanism comprises a weight mounted to a weight deployment member.

12. The assembly as recited in claim 11 wherein said weight deployment member is disposable between a deployed orientation and a retracted orientation.

13. The assembly as recited in claim 12 wherein said counterweight mechanism further comprises a deployment member housing, said deployment member housing mounted in said signal display unit.

14. The assembly as recited in claim 13 wherein said retracted orientation is at least partially defined by said weight deployment member disposed substantially within said deployment member housing.

15. A multi-directional signal assembly deployable on a surface of a body of water, said assembly comprising:

a signal display unit comprising a buoyant construction, said signal display unit further comprising a plurality of display surfaces, each of said plurality of display surfaces having a substantially rectangular configuration comprising an upper portion and a lower portion, and a rigid material of construction, said signal display unit further comprises an upper cap member and a lower cap member mounted at oppositely disposed ends of said plurality of display surfaces, said lower cap member comprising a dry storage container, a plurality of signal indicia, wherein at least one of said plurality of signal indicia is affixed onto said upper portion of a different one of each of said plurality of display surfaces, a counterweight mechanism interconnected to said signal display unit maintaining said signal display unit in an operative orientation relative to the surface of the body of water, wherein said operative orientation is at least partially defined by each of said plurality of display surfaces disposed in a substantially upright orientation relative to the surface of the body of water, said operative orientation is further defined by maintaining said upper portion of each of said plurality of display surfaces substantially above the surface of the body of water, an illumination system mounted to said signal display unit, said illumination system comprising a plurality of illumination members which increase visibility of said signal display unit while deployed in said operative orientation on the surface of the body of water, and a controller programmed to independently actuate each of said plurality of illumination members upon detection of at least one environmental parameter.

16. The assembly as recited in claim 15 further comprising at least one sensor to detect said at least one environmental parameter, said sensor transmitting said at least one environmental parameter to said controller.

* * * * *